United States Patent [19]

Hurutachi et al.

[11] Patent Number: 4,723,414

[45] Date of Patent: Feb. 9, 1988

[54] LOW-TEMPERATURE SHOWCASE

[75] Inventors: Hideake Hurutachi; Takashi Takizawa; Tsutomu Tanaka, All of Gunma, Japan

[73] Assignee: Sanyo Electric Co. Ltd., Osaka, Japan

[21] Appl. No.: 791,781

[22] Filed: Oct. 28, 1985

[30] Foreign Application Priority Data

Oct. 31, 1984 [JP] Japan ..... 59-165017[U]
Jul. 18, 1985 [JP] Japan ..... 60-159121

[51] Int. Cl.[4] ..... F25D 21/06

[52] U.S. Cl. ..... 62/155; 62/156; 62/199; 62/256

[58] Field of Search ..... 62/155, 156, 275, 276, 62/199, 200, 180, 186, 255, 256, 152, 234

[56] References Cited

U.S. PATENT DOCUMENTS

| | | | |
|---|---|---|---|
| 2,763,132 | 9/1956 | Jue | 62/200 X |
| 2,939,295 | 6/1960 | Robson | 62/156 X |
| 3,304,740 | 2/1967 | Dickson et al. | 62/256 |
| 3,623,334 | 11/1971 | Heidorn | 62/276 X |
| 4,122,892 | 10/1978 | Delaporte | 62/199 X |
| 4,265,092 | 5/1981 | Abraham | 62/276 X |

*Primary Examiner*—Harry Tanner
*Attorney, Agent, or Firm*—Darby & Darby

[57] ABSTRACT

A low-temperature showcase comprises a heat insulated wall, on the top of which an opening for putting-into or taking-out commodities is formed. The inside of the heat insulated wall is divided into an air passage and a storage chamber thereover by a dividing plate which is installed inside this heat insulated wall in a nearly horizontal fashion. The air passage is formed in a manner that the cross-section thereof is of a U-shape, and the storage chamber is formed surrounded by this air passage. At both ends of the air passage, vent ports are formed at the positions facing each other through the opening of the heat insulated wall inbetween. The air passage is divided into two parts by a fan case corresponding to the respective vent ports and a blast fan which can rotate reversibly is supported by this fan case. In each halved air passage, an evaporator is installed in the vicinity of the vent port, and when one of the evaporators is put in cooling operation, the other evaporator is subjected to defrosting. An electric heater is installed between each vent port and each evaporator, and these electric heaters are energized when the corresponding evaporator is to be defrosted. By means of a thermo-switch, energizing of the electric heater is stopped when the air temperature in the air passage rises above a predetermined value during energizing the electric heater.

5 Claims, 6 Drawing Figures

LOW-TEMPERATURE SHOWCASE

BACKGROUND OF THE INVENTION

1. Field of the Invention

The present invention relates to a low-temperature showcase. More specifically, the present invention relates to a low-temperature showcase wherein evaporators are installed in the vent ports located at both sides of a storage chamber, respectively associated therewith, and a blast fan which can rotate reversibly is installed in the air passage, and thereby the two evaporators are put in cooling operation alternatively.

2. Description of the Prior Art

The low-temperature showcases of this kind are disclosed, for example, in the Japanese Patent Application Laid-Open No. 47176/1982 laid open on Mar. 17, 1982, the Japanese Patent Application Laid-Open No. 178176 laid open on Oct. 19, 1983 or the like. In these prior arts, an air passage around a storage chamber is divided into two parts by a fan case, and a blast fan capable of blowing air in both directions of the air passage is installed on this fan case. Then, evaporators are installed respectively in the air passages of both sides of the blast fan and operations thereof are switched over alternatively in a manner that when one of the evaporators is put in cooling operation, the other evaporator is put in defrosting operation. When the evaporator is put in defrosting operation, a refrigerant of high temperature which has passed through a condenser is carried through this evaporator.

In the above-described prior art, each evaporator comprises an evaporating pipe for evaporating reduced-pressure liquid refrigerant and a defrosting pipe for passing through the high-temperature refrigerant. When one of the evaporators is put in defrosting operation, this evaporator is heated wholly by the defrosting pipe, and therefore the temperature of the air which has passed through the evaporator during defrosting is high and thereby the air of high temperature becomes a load of refrigeration for the other evaporator in cooling operation. Consequently, a large cooling capacity of evaporator is required, and thereby not only energy consumption becomes larger, but also the cost becomes higher.

SUMMARY OF THE INVENTION

Therefore, the principal object of the present invention is to provide a novel low-temperature showcase.

Another object of the present invention is to provide a low-temperature showcase which can solve problems in defrosting the evaporator.

Still another object of the present invention is to provide a low-temperature showcase which can employ evaporators of smaller cooling capacity.

The other object of the present invention is to provide a low-temperature showcase which can control operation thereof in response to the open-air temperature.

A low-temperature showcase in accordance with the present invention comprises a heat insulated wall whereon an opening for putting into or taking-out goods therethrough is formed. A dividing plate is installed inside from the inner wall of this heat insulated wall, and the inside of the heat insulated wall is divided into an air passage and a storage chamber by this dividing plate. At both ends of the air passage, vent ports are formed at the positions facing each other through the opening of the heat insulated wall inbetween. The air passage is divided into two parts by a fan case in association with the vent ports of the both sides, and a blast fan which can rotate reversibly is supported by this fan case. Evaporators are installed in the respective air passages which are halved. An electric heater is installed between each vent port and each evaporator, and these electric heaters are energized when the corresponding evaporator is to be defrosted.

To be further detailed, when one of the evaporators is put in cooling operation, the other evaporator is stopped to operate, being heated by the corresponding electric heater. The cool air which is brought in contact with the open air at the opening and is raised the temperature thereof and then passes through the corresponding vent port is heated by the electric heater, defrosting the other evaporator. The electric heater is installed at the upstream side of the other evaporator and also at the downstream side of the corresponding vent port (intake port) when viewed in the direction of circulation of the cool air. Consequently, heat of the electric heater is scarcely affecting the cool air being heat-exchanged by one of the evaporators and forming a cool air curtain at the opening of the heat insulated wall. Then, in defrosting the other evaporator, the air heated by the corresponding electric heater melts the frost during flow from an intake side of the air of the evaporator to a blowout side thereof, and therefore the latent heat of this heated air is taken away gradually. Then, when defrosting of the other evaporator is completed, energizing of the corresponding electric heater is cut off.

Accordingly, in accordance with the present invention, the air heated by the electric heater is fed to the evaporator to be defrosted, and therefore defrosting can be performed more quickly in comparison with the unit defrosting by a refrigerant such as cited from the prior art. Also, the heat by the electric heater has no thermal effect at all on the cool air forming a cool air curtain. Furthermore, the air heated by the electric heater is deprived of the latent heat thereof during passing through the evaporator in defrosting, and therefore the temperature of the air returning to the evaporator in cooling operation can be suppressed at a low value, and resultingly, the inside of the storage chamber can be maintained at a sufficiently low temperature even if the refrigerating or cooling capacity of the evaporator to be employed is small.

In a preferred embodiment in accordance with the present invention, the air temperature in the air passage is detected by a thermo-detector. Then, when the air temperature in the air passage rises above a predetermined value when the electric heater is energized, energizing of the electric heater is stopped in response to this thermo-detector. Thus, by stopping the heating by the electric heater in response to the air temperature in the air passage, an unnecessary increase in the load of cooling for the evaporator in cooling operation can be prevented.

In another embodiment in accordance with the present invention, when one of the evaporators is put in cooling operation, an electromagnetic valve of the other evaporator is closed. Accordingly, in accordance with this embodiment, the remaining liquid refrigerant of the other evaporator which is defrosted can be recovered to be used as a refrigerant of the evaporator in cooling operation, and therefore a lack of the refrigerant in the evaporator does not take place, and not only a stable cooling operation can be performed but also the speed of rise in temperature in the evaporator in defrosting is increased, and resultingly the defrosting time can be shortened.

In another preferred embodiment in accordance with the present invention, both the temperature of the cool air fed from the vent port and the open-air temperature are detected by two thermo-sensors. Based on these two detected temperatures, the temperature of the cool air to be fed is controlled in an inversely proportional fashion in response to a change in the open-air temperature. In accordance with the embodiment, the temperature of the fed cool air is varied automatically in response to a change in the open-air temperature, and therefore the temperature of the inside of the storage chamber can be maintained within a predetermined temperature range independent of the change in the open-air temperature.

These objects and other objects, features, aspects and advantages of the present invention will be more apparent from the following detailed description of the embodiments of the present invention when taken in conjunction with accompanying drawings.

BRIEF DESCRIPTION OF THE DRAWINGS

FIG. 3 shows a circuit whose power source is three-phase 200 V, and FIG. 4 shows a circuit whose power source is single-phase 100 V.

DESCRIPTION OF THE PREFERRED EMBODIMENTS

Figure 1:
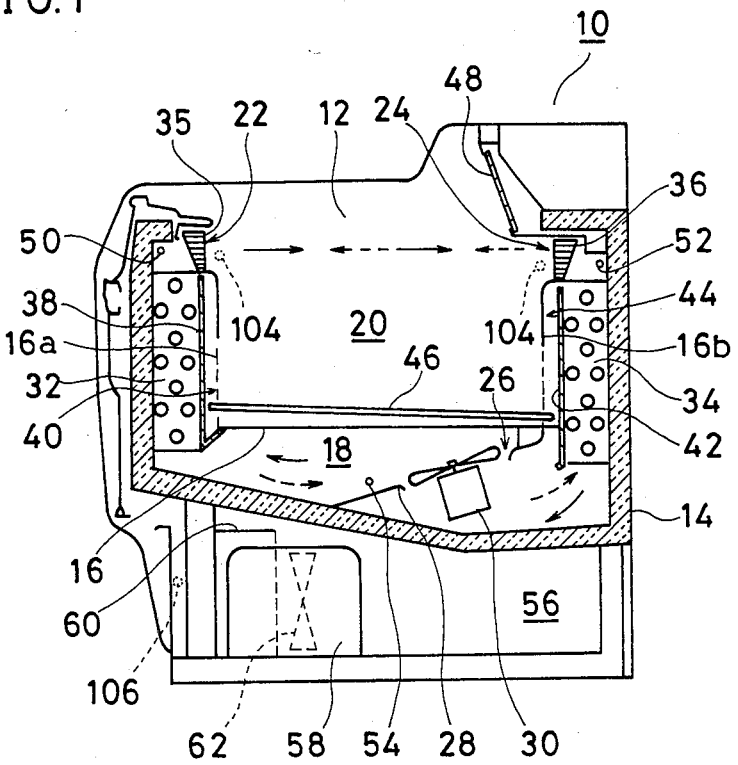
FIG. 1 is a cross-sectional illustrative view showing one embodiment in accordance with the present invention.

FIG. 1 is a cross-sectional illustrative view showing one embodiment in accordance with the present invention. A low-temperature showcase 10 comprises a heat insulated wall 14 whose cross-section is nearly U-shaped and on the top of which an opening 12 is formed. The opening 12 is utilized to put-into goods or take-out goods therethrough, and accordingly, in this embodiment, the low-temperature showcase 10 is constituted as an open type.

Inside the heat insulated wall 14, a metal dividing plate 16 whose cross section is nearly U-shaped is installed in a nearly horizontal fashion. A front plate **16*a* and a rear plate 16*b* of the dividing plate 16 are formed vertically with a predetermined space kept from the inner wall of the corresponding side wall of the heat insulated wall 14. The inside of the heat insulated wall 14 is divided into an air passage 18 and a storage chamber 20 thereover by the dividing plate 16. The air passage is formed in a manner that the cross-section thereof is nearly U-shaped, and at both ends thereof, namely, two top ends, vent ports 22 and 24 are formed so as to face each other through the opening 12 inbetween. The air passage 18 is also divided into two parts in association with the respective vent ports 22 and 24 at both sides of the storage chamber 20 by a fan case 28 whereon a through hole 26** is formed.

A blast fan 30 which can be rotated reversibly is supported in the through hole 26 of the fan case 28, and accordingly, in the air passage 18, air is circulated forcedly in the direction shown by a full line or in the direction shown by a dotted line in FIG. 1.

In the vicinities of the vent ports 22 and 24 of the air passage 18, plate-fin-shaped evaporators 32 and 34 are mounted on the side wall of the heat insulated wall 14, respectively. The rear surface of the evaporator 32 and the front surface of the evaporator 34 face the front plate **16*a* and the rear plate 16*b* of the dividing plate 16, respectively. When one of these two evaporators 32 and 34 is put in cooling operation, the other is defrosted, and accordingly the vent ports 22 and 24 associated with these evaporators function as a blow-off port when the corresponding evaporator is put in cooling operation, and function as an intake port when defrosted, respectively. Honeycomb-shaped flow arranging devices 35 and 36 are installed at these vent ports 22 and 24**, respectively.

A partition plate 38 is installed on the rear surface of the evaporator 32, and a space 40 is formed between this partition plate 38 and the front plate **16*a* of the dividing plate 16. Similarly, a partition plate 42 is installed on the front surface of the evaporator 34, and a space 44 is formed between this partition plate 42 and the rear plate 16*b* of the dividing plate 16. These spaces 40 and 44 can prevent a local temperature rise in the storage chamber 20 caused by direct heat transmission from the evaporators 32 and 34 to the dividing plate 16**.

Above the dividing plate 16, a rack 46 for putting goods thereon is disposed while slanting a little in the direction of the depth of this low-temperature showcase 10. This rack 46 is supported by the front plate **16*a* and the rear plate 16*b* of the dividing plate 16 respectively at the both ends thereof. Furthermore, above the opening 12, a mirror 48 for mirroring the goods stored in the storage chamber 20** is installed.

At the above-described vent ports 22 and 24, electric heaters 50 and 52 are installed inside from the flow arranging devices 35 and 36, respectively. These electric heaters 50 and 52 are energized respectively when the corresponding evaporator 32 or 34 is to be defrosted. Accordingly, defrosting of the evaporator 32 or 34 is achieved by the air heated by the electric heaters 50 and 52.

Furthermore, a thermo-detector 54 is installed in the vicinity of the blast fan 30 in the air passage 18. This thermo-detector 54 is for detecting whether the air temperature in the air passage 18 is above or below a predetermined temperature, for example, 5° C., and a thermo-switch 100 as described later (FIG. 4) is "opened" or "closed" in response to an output of this thermo-detector 54.

A machine room 56 is formed under the heat insulated wall 14, and in this machine room 56 a compressor 58 and a condenser 60 which constitute a refrigerant circuit together with the two evaporators 32 and 34 are accommodated and a blast fan 62 is installed in association with the condenser 60.

Figure 2:
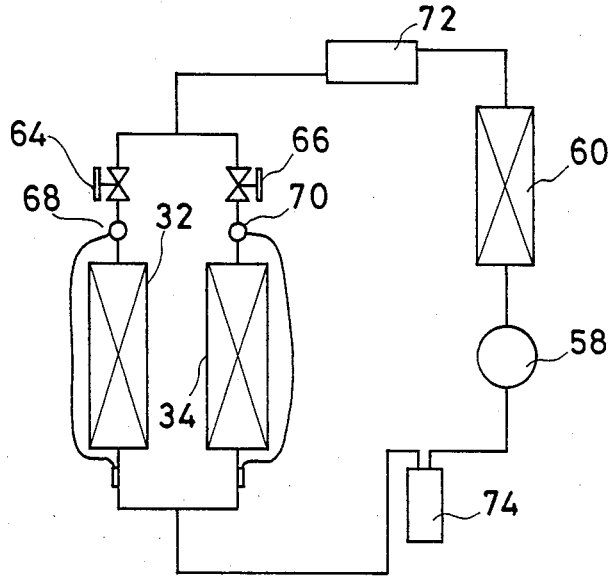
FIG. 2 is a refrigerant circuit diagram of the FIG. 1 embodiment.

The above-described refrigerant circuit is constituted as shown in FIG. 2. To be further detailed, the evaporators 32 and 34 comprise series connections of electromagnetic valves 64 and 66 and expansion valves 68 and 70 respectively, and these evaporators 32 and 34 are connected in parallel. The electromagnetic valves 64 and 66 are connected to the above-described condenser 60, and a liquid receiver 72 is installed on the way thereto. Also, the evaporators 32 and 34 are connected to the compressor 58, and a gas-liquid separator 74 is installed on the way thereto. Then, the compressor 58 and the condenser 60 are connected in series. The refrigerant flows from the compressor 58, passes through the condenser 60 and reaches the evaporator 32 and 34. Accordingly, in this embodiment, the evaporators 32 and 34 perform only cooling operation, being defrosted in the state wherein the operation is stopped.

Meanwhile, the above-described electromagnetic valves 64 and 66 are opened and closed alternately every given period of time by a time switch 102 (FIG. 4) as describe later.

Figure 3:
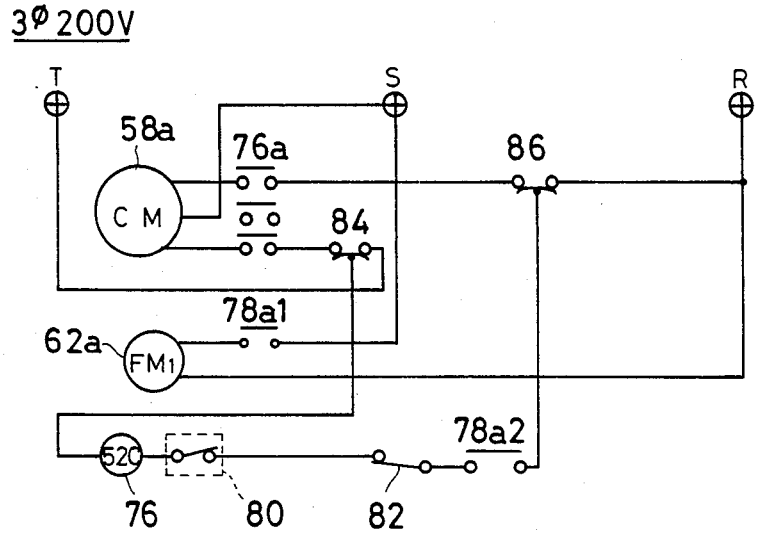
FIG. 3 and FIG. 4 are sequence diagrams showing control circuits of FIG. 1 embodiment.
Figure 4:
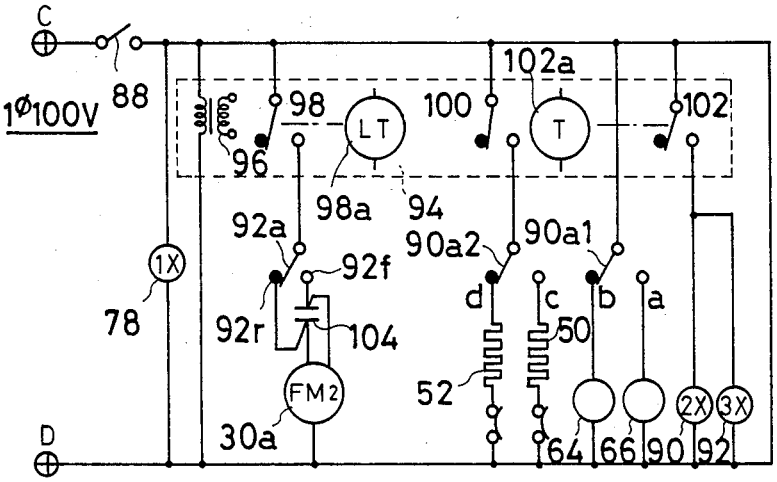

FIG. 3 and FIG. 4 are circuit diagrams showing control circuits of the above-described embodiment, FIG. 3 is a circuit of a power source of three-phase 200 V, and FIG. 4 is a circuit of a power source of single-phase 100 V. In reference to FIG. 3, a compressor motor 58*a* for the compressor 58 is connected to respective phases R, S and T through a contact 76*a* of an electromagnetic switch 76. A fan motor 62*a* for the blast fan 62 (FIG. 1) is connected across the two phases R and S through a normally opened contact 78*a*1 of a first auxiliary relay 78 (FIG. 4). The above-described electromagnetic switch 76 is connected in series together with a thermostat 80 for responding to the temperature of the storage chamber 20, a pressure switch 82 and a second normally opened contact 78*a*2 of the first auxiliary relay 78, being connected across the two phases R and T through two over-load relays 84 and 86.

In reference to FIG. 4, to a power source of single-phase 100 V, the first auxiliary relay 78 is connected through an operating switch 88, and also a second auxiliary relay 90 and a third auxiliary relay 92 are connected through a controller 94. The controller 94 comprises an internal power source 96, a delay switch 98, the thermo-switch 100, and the time switch 102. A fan motor 30*a* for the blast fan 30 (FIG. 1) is connected through the delay switch 98, a contact piece 92*a* of the third auxiliary relay 92 and an operating capacitor 104. To be detailed, the contact piece 92*a* of the third auxiliary relay 92 can be connected to a forward rotation contact 92*f* or a reverse operation contact 92*r*, and thereby the fan motor 30*a* is rotated reversibly. The above-described electromagnetic valves 64 and 66 are connected through a contact piece 90*a*1 of the second auxiliary relay 90. To be detailed, the contact piece 90*a*1 of the second auxiliary relay 90 can be connected to a normally opened contact a or a normally closed contact b, and thereby either of the electromagnetic valves 64 and 66 can be energized. Furthermore, the two electric heaters 50 and 52 (FIG. 1) are connected through the thermo-switch 100 and a contact piece 90*a*2 of the second auxiliary relay 90. To be detailed, the contact piece 90*a*2 can be connected to a normally opened contact c or a normally closed contact d, and thereby either of the electric heaters 50 and 52 can be energized when the thermo-switch 100 is closed.

The above-described time switch 102 is closed or opened, for example, every two hours by a signal from an associated timer 102*a*, and accordingly the second and the third auxiliary relays 90 and 92 are energized, for example, every two hours. Also, the thermo-switch 100 is opened or closed by a signal from the above-described thermo-detector 54, and is "opened" when the air temperature in the air passage 18 (FIG. 1) is 5° C. or more, being "closed" when it is a predetermined temperature below 5° C. Furthermore, the delay switch 98 is opened or closed by a signal from an associated delay timer 98*a*, and this delay timer 98 is driven, for example, from the point when the time switch 102 is opened or closed, being closed, for example, after two minutes has elapsed. This is for completely stopping the fan motor 30*a* of the blast fan 30 when it is changed over from forward rotation to reverse rotation or vice versa. This fan motor 30*a* is forward-rotated when the contact piece 92*a* of the third auxiliary relay 92 is connected to the forward rotation contact 92*f*, being reverse-rotated when the contact piece 92*a* is connected to the reverse rotation contact 92*r*.

Next, description is made on operation of the low-temperature showcase 10 of this embodiment in reference to FIG. 1 through FIG. 4. First, the operating switch 88 (FIG. 4) is closed. Responsively, the first auxiliary relay 78 is energized, and the two contacts 78*a*1 and 78*a*2 thereof are closed. Consequently, the electromagnetic switch 76 is energized, and the contact 76*a* thereof is closed and the compressor motor 58*a* is energized. Accordingly, the compressor 58 (FIG. 1) is driven. At this time, when the time switch 102 is "closed", both of the second and the third auxiliary relays 90 and 92 are kept de-energized intact, and therefore the contact piece 90*a* of the second auxiliary relay 90 is connected to the normally closed contact b and the contact piece 92*a*2 is connected to the normally closed contact d respectively, and the contact piece 92*a* of the third auxiliary relay 92 is connected to the reverse rotation contact 92*r*. Thereby, the electromagnetic valve 64 is energized to be "opened", and the liquid refrigerant is fed to the corresponding evaporator 32, and cooling operation is started.

In the initial stage of operation, the air temperature in the air passage 18 is high, for example, 5° C. or more, and therefore the thermo-switch 100 is kept "opened" intact in response to an OFF signal from the thermo-detector 54. Accordingly, the electric heater 52 is not energized.

When two minutes elapse after the operating switch 88 is closed, the delay switch 98 is closed, and thereby the fan motor 30*a* is energized through the contact piece 92*a* and the reverse rotation contact 92*r*, and the blast fan 30 is reverse-rotated. When the blast fan 30 is reverse-rotated, as shown by a full-line arrow in FIG. 1, the cool air heat-exchanged by the evaporator 32 is circulated to form a cool air curtain at the opening 12. The storage chamber 20 is cooled by this air curtain.

In the middle of such a cooling operation of the evaporator 32, when the thermo-detector 54 detects that the air temperature in the air passage 18 has become a predetermined temperature, for example, 5° C. or less, responsively the thermo-switch 100 is closed. Consequently, energizing of the electric heater 52 is started, the cool air returning to the evaporator 32 is heated, and the evaporator 34 is defrosted.

When two hours elapse after the operating switch 88 is turned on, the timer 102*a* expires, and in response to the output thereof the time switch 102 is closed, and also the delay timer 98*a* is reset, and the delay switch 98 is opened. Consequently, the second and the third auxiliary relays 90 and 92 are energized, and the contact pieces 90*a*1 and 90*a*2 of the second auxiliary relay 90 are connected to the normally opened contacts a and c respectively, and also the contact piece 92*a* of the third auxiliary relay 92 is switched over to the forward rotation contact 92*f*. Attending on such a switching operation, the electromagnetic valve 66 is "opened", and the reduced-pressure liquid refrigerant is fed to the evaporator 34, and thereby cooling operation by this evaporator 34 is started, and also the electric heater 50 is energized.

Then, when two minutes elapse after the above-described switching over, the delay switch 98 is closed in response to an output from the delay timer 98*a*. Responsively, the fan motor 30*a* is energized, and the blast fan 30 (FIG. 1) is forward-rotated. Attending on this forward rotation of the blast fan 30, the cool air heat-exchanged by the evaporator 34 is circulated forcedly as shown by a dotted-line arrow in FIG. 1 to form a cool air curtain at the opening 12. On the other hand, the evaporator 32 is defrosted by the electric heater 50.

Thereafter, such a cooling operation by the evaporator 32 or 34 is performed alternately every time by the timer 102*a*, that is, every two hours. Then, for example, when one evaporator 34 or 32 is put in cooling operation, the other evaporator 32 or 34 is defrosted by the corresponding electric heater 52 or 50.

During cooling operation of one evaporator 34, the electric heater 50 heating the other evaporator 32 is positioned at the upstream side from the evaporator 32 and at the downstream side from the vent port 22 as an intake port when viewed in the direction of circulation of air flow, and therefore the electric heater 50 has scarcely thermal effect on the cool air forming the cool air curtain at the opening 12 among the cool air heat-exchanged by the evaporator 34. Also, the cool air is brought in contact with the open air at the opening 12, thereby the temperature thereof rises, then the air passes through the vent port 22, thereafter this air is heated by the electric heater 50, and thereby defrosting of the evaporator 32 can be performed. In defrosting this evaporator 32, the air heated by the electric heater 50 melts the frost depositing on the evaporator 32 during flowing from the top end to the bottom end of the evaporator 32, and therefore the latent heat thereof is taken away gradually. Consequently, the temperature of the circulating cool air after passing through the evaporator 32 does not rise until defrosting of the evaporator 32 is completed, and accordingly the temperature of the cool air returning to the evaporator 34 in cooling operation can be maintained intact at a low value. Resultingly, the cooling capacity of the evaporator 34 performing cooling operation can be small and also the defrosting efficiency of the evaporator 32 in defrosting is improved.

Energizing of the electric heater 50 can be cut off forcedly by the thermo-switch 100 after defrosting of the evaporator 32 is completed, or in response to a temperature rise in the air passage 18 attending on a rise in temperature of the open air, or in response to an OFF signal from the thermo-detector 54 irrespective of switching-over by the time switch 102. Accordingly, an increase in the load of refrigeration for the evaporator 34 performing cooling operation can be suppressed.

Furthermore, when cooling operation is performed by one evaporator 34, the electromagnetic valve 64 associated with the other evaporator 32 is closed by connecting the contact piece 90*a* of the second auxiliary relay 90 to the normally opened contact a. Accordingly, the remaining liquid refrigerant of the evaporator 32 in defrosting can be recovered gradually. Consequently, a lack of the refrigerant for the evaporator 34 in cooling operation does not take place and thereby a stable cooling operation can be performed. Then, since the remaining liquid refrigerant in the evaporator 32 to be defrosted is removed, the speed of rise in temperature of the evaporator 32 is fast, and thereby the time required for defrosting the evaporator 32 can be shortened.

In addition, the above-described description is made on the case where one evaporator 34 is put in cooling operation and the other evaporator 32 is defrosted. However, the operation is the same also in the case where, in reverse, the evaporator 32 is put in cooling operation and the evaporator 34 is defrosted, and therefore duplicate description is omitted here.

Since the space 40 and 44 are formed between the two evaporators 32 and 34 and the dividing plate 16 by the partition plates 38 and 42, no heat is transferred directly to the dividing plate 16 from the respective evaporator 32 and 34 even in cooling operation or in defrosting. Consequently, the storage chamber 20 can be maintained at a predetermined temperature nearly uniformly over the whole are thereof.

Figure 5:
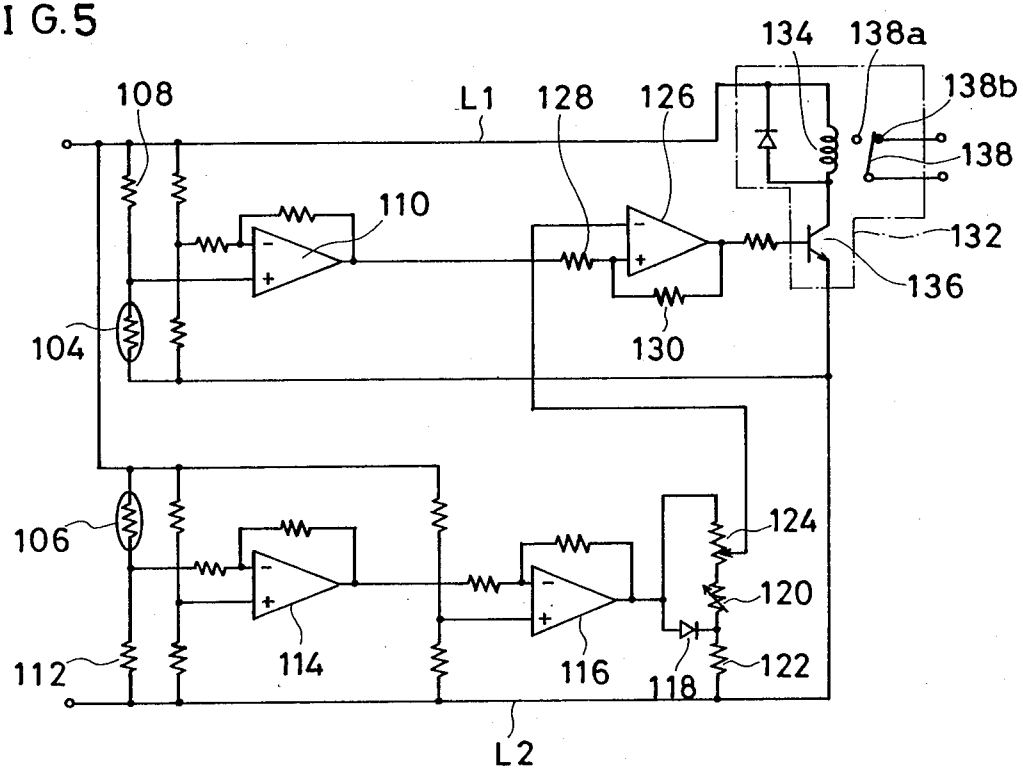
FIG. 5 is a circuit diagram showing a control circuit of another embodiment in a accordance with the present invention.

FIG. 5 is an electric circuit diagram showing another embodiment in accordance with the present invention. In this embodiment, a first thermo-sensor 104 and a second thermo-sensor 106 as shown in FIG. 1 are employed. The first thermo-sensor 104 is installed at the portion of the opening 12 in the vicinity of the vent ports 22 and 24. This first thermo-sensor 104 detects the temperature of the cool air which is heat-exchanged by the evaporators 32 or 34 and is blown out from the vent ports 22 and 24. The second thermo-sensor 106 is installed outside the machine room 56, for example, in the vicinity of the open-air intake port of the condenser 60, and detects the open-air temperature. These first and second thermo-sensors 104 and 106 are, for example, thermistors of negative characteristic, respectively.

One end of the first thermo-sensor 104 is connected to a power source line L1 through a resistor 108 and the connection point of this resistor 108 and the first thermo-sensor 104 is connected to an input of a first amplifier 110. The other end of the first thermo-sensor 104 is connected to another power source line L2. On the other hand, one end of the second thermo-sensor 106 is connected to the second power source line L2 through a resistor 112, and the connection point of the second thermo-sensor 106 and the resistor 112 is connected to an input of a second amplifier 114. The other end of the second thermo-sensor 106 is connected to the power source line L1.

Output of the second amplifier 114 is further amplified by a third amplifier 116. The output of this third amplifier 116 is connected to the series connection point of a variable resistor 120 and a resistor 122 through a diode 118 of forward direction. To the other end of the variable resistor 120, a semi-fixed resistor 124 is further connected, and the other end of this semi-fixed resistor 124 is connected to the above-described output of the third amplifier 116. The variable resistor 120 is for setting the temperature in the storage chamber 20 (FIG. 1), and the diode 118 is employed as a constant current device for keeping the potential difference between the both ends of the variable resistor 120 at a constant value. The semi-fixed resistor 124 is employed to make fine adjustment of the potential of the variable resistor 120, and the resistor 122 acts as a bias resistance of the diode 118.

The above-described output of the first amplifier 110 is given to a (+) terminal of a comparator 126, and the output of the third amplifier 116 is given to a (−) terminal of the comparator 126 through the variable resistor 120, that is, the semi-fixed resistor 124. Resistors 128 and 130 connected to the comparator 126 is for giving a hysteresis characteristic to this comparator 126. An output of the comparator 126 is given to an operation control circuit 132.

The operation control circuit 132 comprises a relay coil 134 for controlling operation of the compressor 58 (FIG. 1), and this relay coil 134 is connected between the power source lines L1 and L2 through a switching transistor 136. This relay coil 134 is considered to be same one as the first auxiliary relay 78 as shown in FIG. 4. A fly-wheel diode is connected in parallel with the relay coil 134. Also, a switch-over contact piece 138 which is switched by the relay coil 134 is installed. This switching-over contact piece 138 is switched-over to a normally opened contact 138*a* or a normally closed contact 38*b* in response to energizing or de-energizing of the relay coil 134. Then, the compressor 58 (FIG. 1) is operated when the relay coil 134 is de-energized and the switch-over contact piece 138 is in contact with the normally closed contact 138*b*.

In a circuit as shown in FIG. 5, assume that when the open-air temperature is normal temperature, for example 20° C., the temperature of the cool air to be fed is set to 0° C. In the state wherein no open-air temperature is varied, the resistance value of the second thermo-sensor 106 and accordingly the output of the second amplifier 114 are scarcely varied. Accordingly, the voltage given to the comparator 126 from the variable resistor 120 is also nearly constant. Then, when a high-level signal is outputted from the comparator 126, responsively the switching transistor 136 is turned on, and the relay coil 134 is energized. Accordingly, the switch-over contact piece 138 associated with this relay coil 134 is connected to the normally closed contact 138*a*, and the compressor 58 is stopped to operate.

When the temperature of the storage chamber 20 (FIG. 1) rises and thereby the temperature of the cool air blown out from the vent port 22 or 24 rises in the state wherein the compressor 58 (FIG. 1) is stopped, the resistance value of the first thermo-sensor 104 is reduced. Then, the output of the first amplifier 110 is also reduced, and the voltage given to the (+) terminal of the comparator 126 is also reduced. Then, when the temperature of the cool air to be fed further rises, the voltage of the (+) terminal of the comparator 126 becomes lower than the voltage of the (−) terminal thereof. Then, the output of the comparator 126 is switched over to the low level, and the switching transistor 136 is turned off. Accordingly, the relay coil 134 is de-energized, and the switched-over contact 138*b*, and operation of the compressor 58 is started.

When the temperature of the cool air to be fed falls by operation of the compressor 58, the resistance value of the first thermo-sensor 104 is increased. Responsively, the output of the first amplifier 110 is also increase, and the input voltage to the (+) terminal of the comparator 126 also rises. Then, when the temperature of the cool air to be fed further falls, the voltage of the (+) terminal of the comparator 126 becomes higher again than the voltage of the (−) terminal thereof. Then, a high-level signal is outputted from the comparator 126, the switching transistor 136 is turned on, and operation of the compressor 58 is stopped.

Thereafter, the above described operation is repeated, and the compressor 58 repeats operation and stop. Accordingly, the temperature in the storage chamber 20 (FIG. 1), that is, the temperature of the cool air fed from the vent port 22 or 24, for example, as shown by a line A in FIG. 6, varies, for example, between −0.5° C. and +0.5° C. so as to maintain the temperature set by the variable resistor 120, for example, 0° C.

When the open-air temperature varies, the output voltage of the second amplifier 114 also varies. When the open-air temperature rises, for example, to 25° C. from 20° C., the resistance value of the second thermo-sensor 106 decreases, and the output of the second amplifier 114 decreases. The third amplifier 116 inversely amplifies the output of the second amplifier 114, and accordingly, the output of the third amplifier 116 increases at that time. Consequently, the potential of the variable resistor 120 also rises, and the voltage of the (−) terminal of the comparator 126 also rises.

Suppose that the temperature of the cool air to be fed rises gradually and the output voltage of the first amplifier 110 is reduced gradually in the state wherein the compressor 58 is stopped. Then, a low-level signal is outputted from this comparator 126 at a temperature of the fed cool air, for example, −0.5° C. which is further lower than the temperature of the fed cool air (+0.5° C.) when the comparator 126 outputs a low-level signal at an open-air temperature of 20° C. Then, when a low-level signal is outputted from the comparator 126, as is described above, the switching transistor 136 is turned off, and operation of the compressor 58 is resumed.

When the operation of the compressor 58 is continued and the temperature of the cool air to be fed is reduced gradually, the output of the comparator 126 turns to the high level again. That is, the comparator 126 outputs a high-level signal when the open-air temperature becomes a temperature, for example, −1.5° C., which is lower than the temperature of the fed cool air (−0.5° C.) when the comparator 126 outputs a high-level signal at an open-air temperature of 20° C. Then, in response to an output of high-level signal, the switching transistor 136 is turned on, and operation of the compressor 58 is stopped.

Figure 6:
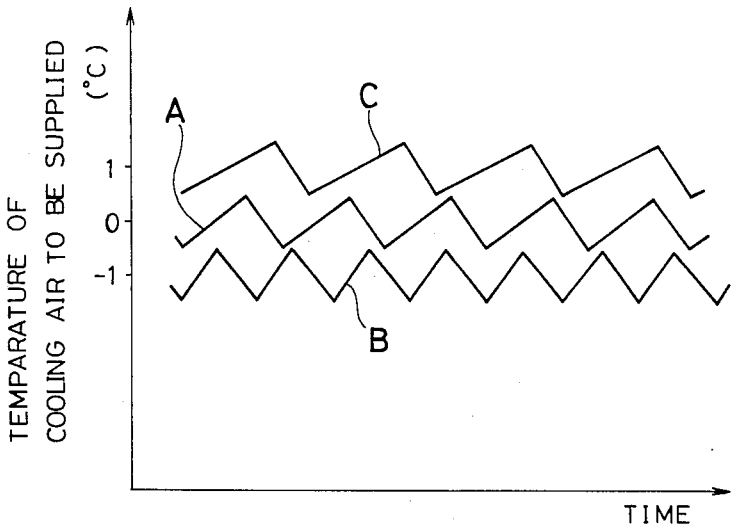
FIG. 6 is a graph for explaining a state of controlling the temperature in accordance with FIG. 5 embodiment.

Thus, when the open-air temperature rises, for example, to 25° C. by repeating operation and stop of the compressor 58, the temperature of the cool air fed from the vent port 22 or 24, as shown by a line B in FIG. 6, is controlled lower in comparison with that in the state wherein the open-air temperature is, for example, 20° C., that is, the state as shown by the line A, and also the thermo-cycle thereof becomes shorter. Thus, when the open-air temperature rises, for example, to 25° C., the temperature of the cool air to be fed is controlled, for example, within a range of −1.5° C.~0.5° C., and the inside of the storage chamber 20 can be maintained at the same temperature as that before the open air temperature rises.

Meanwhile, in the embodiment, the temperature of the cool air to be fed is controlled in inverse proportion to the open-air temperature so as to be lowered by about 0.2° C. when the open-air temperature rises by 1° C.

When the open-air temperature falls, for example, from 20° C. to 15° C., the voltage of the second thermo-sensor 106 rises, and the output voltage of the second amplifier 114 rises. Consequently, the output voltage of the third amplifier 116, that is, the voltage outputted from the variable resistor 120 falls.

Here, suppose that the temperature of the cool air fed from the vent port 22 or 24 rises in the state wherein operation of the compressor 58 is stopped. In this state, the voltage of the first thermo-sensor 104 falls gradually, and accordingly the output voltage of the first amplifier 110 also falls gradually. Then, when the temperature of the fed cool air becomes higher, for example, becomes +1.5° C., than the temperature of the fed cool air (+0.5°) when the comparator 126 outputs the low-level signal at an open-air temperature of 20° C., the voltage of the (+) terminal of the comparator 126 becomes lower than that of the (−) terminal thereof, and the output of the comparator 126 is switched over to the low level. Responsively, operation of the compressor 58 is resumed.

When the operation of the compressor 58 is continued and the temperature of the cool air to be fed falls gradually, the voltage of the fist thermo-sensor 104, that is, the voltage of the (+) terminal of the comparator 126 rises. The voltage of the (+) terminal of the comparator 126 becomes higher than that of the (−) terminal thereof at a higher temperature (for example, at +0.5° C.) than the temperature of the fed cool air (−0.5° C.) when the comparator 126 outputs the high-level signal at an open-air temperature of 20° C. Responsively, the comparator 126 outputs the low-level signal, and operation of the compressor 58 is stopped.

Thus, when the open-air temperature falls, for example, from 20° C. to 15° C., by repeating operation and stop of the compressor 58, the temperature of the cool air to be fed is controlled within a range of +0.5° C.−+1.5° C. as shown by a line C in FIG. 6. Accordingly, when the open-air temperature is 15° C., the temperature is maintained higher than that in the state wherein the open-air temperature is 20° C., that is, the state as shown by the line A, and the thermo-cycle thereof also becomes longer.

Meanwhile, the temperature of the cool air to be fed is controlled in reverse proportion to the open-air temperature so as to rise, for example, by 0.2° C. when the open-air temperature falls by 1° C.

Thus, in response to a change in the open-air temperature, the output voltage of the second amplifier 114 also changes, and the voltage of the (−) terminal of the comparator 126 changes. Then, when the open-air temperature becomes higher than normal temperature (for example, 20° C.), both of the temperature of the fed cool air at which the compressor 58 starts to operate, that is, the upper limit of the temperature of the cool air to be fed and the temperature of the fed cool air at which the compressor 58 stops to operate, that is, the lower limit of the temperature of the cool air to be fed are reduced automatically, and therefore, the temperature in the storage chamber 20 is controlled within a range nearly equal to that before the open-air temperature rises, and also the thermo-cycle thereof is also shortened. Resultingly, in accordance with this embodiment, the temperature in the storage chamber 20 is scarcely changed and is maintained at a nearly constant value even when the open-air temperature rises and the radiant heat reaching the inside of the storage chamber 20 from the opening 12 through the air curtain is increased. Also, when the open-air temperature falls, both the upper limit and the lower limit of the temperature of the cool air to be fed rise automatically, and therefore the temperature of the storage chamber 20 is controlled within a range nearly equal to that before the open-air temperature falls, and also the thermo-cycle becomes longer. Resultingly, even when the open-air temperature falls and the radiant heat into the storage chamber 20 from the opening 12 is decreased, the temperature in the storage chamber 20 is scarcely changed, and accordingly the temperature is maintained at nearly the same value as that in the state at normal temperature.

Thus, in accordance with FIG. 5 embodiment, the temperature in the storage chamber 20 can be kept at nearly a constant value independent of the open-air temperature, and the quality of the food whose optimum temperature range is relatively small can be maintained in good state over a long period.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A low temperature showcase, comprising:

a heat insulated wall having an inside and an opening;

a dividing plate for dividing the inside of said insulated wall into an air passage and a storage chamber;

two vent ports being disposed at both ends of said air passage so as to face each other, said opening being disposed between said two vent ports;

a fan casing dividing said air passage into two portions having ends which are formed as said vent ports;

a blast fan supported by said fan casing and being able to rotate reversibly;

timer means for alternately changing over the rotation direction of said blast fan;

two evaporators being disposed in the respective portions of said air passage, one of which being disposed between one vent port and said fan casing and the other of which being disposed between the other vent port and said fan casing, said two evaporators being put alternatively in a cooling operation by said timer means; and two electric heaters being respectively disposed between corresponding vent ports and said evaporators, said two electric heaters being energized by said timer means when the corresponding evaporator is changed-over from the cooling operation by said timer means;

whereby when one of said two evaporators is put in the cooling operation, the other evaporator is put in the defrosting operation and is defrosted by air heated by the electric heater corresponding thereto.

2. A low temperature showcase in accordance with claim 1, further comprising air temperature sensing means for sensing an air temperature of said air passage, and deenergizing means for deenergizing said electric heater corresponding to the evaporator being defrosted in response to a detection of the predetermined temperature by said air temperature sensing means.

3. A low temperature showcase in accordance with claim 1, wherein said two evaporators include an electromagnetic valve in association therewith and further comprising means for closing said electromagnetic valve of said evaporator in response to said timer means when the corresponding evaporator is not put in the cooling operation.

4. A low temperature showcase in accordance with claim 1, wherein said air passage is formed in a U-shaped so that said opening is formed by the upper peripheral of said heat insulated wall.

5. A low temperature showcase in accordance with claim 1, further comprising delay means for delaying energizing of a motor for said blast fan at the time when the rotation direction of said blast fan is changed-over by said timer means.

* * * * *